United States Patent [19]

Fender

[11] Patent Number: 4,581,975

[45] Date of Patent: Apr. 15, 1986

[54] PICK-UP FOR AN ELECTRICAL MUSICAL INSTRUMENT OF THE STRINGED TYPE

[76] Inventor: C. Leo Fender, 1510 Dana Pl., Fullerton, Calif. 92635

[21] Appl. No.: 598,505

[22] Filed: Apr. 9, 1984

[51] Int. Cl.[4] ..... G10H 3/18

[52] U.S. Cl. ..... 84/1.15; 84/1.16

[58] Field of Search ..... 84/1.14–1.16

[56] References Cited

U.S. PATENT DOCUMENTS

| | | | |
|---|---|---|---|
| 3,483,303 | 12/1969 | Warner | 84/1.15 |
| 3,915,048 | 10/1975 | Stich | 84/1.14 |
| 4,151,776 | 5/1979 | Stich | 84/1.16 |
| 4,175,462 | 11/1979 | Simon | 84/1.16 |
| 4,222,301 | 9/1980 | Valdez | 84/1.15 |

*Primary Examiner*—Stanley J. Witkowski

*Attorney, Agent, or Firm*—Spensley, Horn, Jubas & Lubitz

[57] ABSTRACT

A humbucking pick-up for an electrical musical instrument of the stringed type including two or three primary pick-up assemblies and, in either case, a lesser number of additional pick-up assemblies are all that is necessary to provide for humbucking, the secondary pick-up assemblies not being used for signal generation. The pick-up includes an instrument mounted preamplifier. With the preamplifier in use, the signals from the primary and secondary pick-up assemblies are summed thereat. The preamplifier may be bypassed and the signals from the primary pick-up assemblies conducted directly to an amplification system. This is accomplished while maximizing the output signal and still permitting humbucking. A dual tone control arrangement is provided so that the primary and secondary coils can be balanced simultaneously. The arrangement of the primary coils is such that the operation of the secondary humbucking coils is not affected thereby.

15 Claims, 7 Drawing Figures

PICK-UP FOR AN ELECTRICAL MUSICAL INSTRUMENT OF THE STRINGED TYPE

BACKGROUND OF THE INVENTION

1. Field of the Invention

The present invention relates to a pick-up for an electrical musical instrument of the stringed type and, more particularly, to a pick-up for an electrical musical instrument of the stringed type having greater versatility with fewer pick-up assemblies than has been achieved heretofore.

2. Description of the Prior Art

The present invention relates broadly to electrical musical instruments of the stringed type. It is particularly applicable to an electrical guitar or similar musical instrument having a plurality of stretched strings extending across a body and a neck, between the head of the instrument and a bridge assembly connected to the body, in which the strings are caused to vibrate by plucking or picking same.

In order to derive an output from such an electrical guitar or other similar electrical musical instrument, the instrument is conventionally provided with an electromagnetic pick-up comprising a number of magnetic elements (pole pieces) having wound therearound a conductive coil. Typically, one such magnetic element is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate, this causes a disturbance in the magnetic field of the associated pole piece. This has the effect of generating a voltage in the conductive coil, which voltage may be suitably amplified and transmitted to a loudspeaker system.

With such an electromagnetic pick-up construction, a number of problems exist. Electric guitars and other similar electrical musical instruments are used in areas having strong magnetic fields from lighting fixtures, motors, transformers, and the like, and these magnetic fields are sensed by the pick-up as an extraneous noise source. In the United States, such source typically has a frequency of 60 Hz, the usual power line frequency. These magnetic fields induce voltages in the coil which are also amplified and transmitted to the loudspeaker system, manifesting themselves in an objectionable hum.

In order to overcome this problem, it is known to provide a pick-up for an electrical musical instrument including a pair of identical pick-up assemblies, each having a plurality of magnetic pole pieces and a coil, the pick-up assemblies being positionable in parallel, spaced, closely adjacent relationship. All of the pole pieces of one of the pick-up assemblies have their north poles adjacent to the strings and their south poles relatively remote from the strings whereas all of the pole pieces of the other pick-up assembly have their south poles adjacent to the strings and their north poles relatively remote from the strings. The coils of the two pick-up assemblies are wound in opposite directions and the two coils are connected either in series or in parallel. Because the direction of current flow in each coil is governed by the magnetic polarity, the direction of current flow in one coil is opposite to that of the other coil for each string. However, since the directions of the windings of the two coils are opposite, the signal induced in each coil as a result of string vibrations is additive and the output signal is the sum of the signals induced in each coil.

On the other hand, signals picked up by the coils from power line sources produce currents in the coils which are independent of the magnetic polarity and, accordingly, such power line sources produce voltages that are in phase. However, since the coils are wound in opposite directions, these in phase signals cancel and the output signal is the difference between the power line signals induced in each coil. This means that any noise from power line sources, which is otherwise manifested as an objectionable hum, is effectively reduced or cancelled. It is for this reason that such an arrangement is typically characterized as a humbucking arrangement.

From the above it can be seen that whenever it is desired to have a humbucking arrangement, it is necessary to have pairs of pick-up assemblies. Thus, it is common for electrical musical instruments to have two, four or six pick-ups. It would be desirable to be able to minimize the number of pairs of pick-up assemblies while still having a humbucking arrangement.

It is also common to sum the inputs from the different pairs of pick-up assemblies into a preamplifier before conducting the signal from the pick-up assemblies to the amplification system. Occasionally, the preamplifier becomes inoperative either because of problems associated therewith or because the batteries which run same within the instrument go dead. In such case, only the main coils are conducted to the amplification system and the humbucking pairs are not used. In such case, it would be desirable to maximize the signal and to still, if possible, have a humbucking arrangement. Other problems are further addressed herein.

SUMMARY OF THE INVENTION

According to the present invention, these problems are solved in a manner unknown heretofore. According to the present invention, an electrical musical instrument of the stringed type is provided with two or three primary pick-up assemblies and, in either case, a lesser number of additional secondary pick-up assemblies are all that is necessary to provide a humbucking arrangement. Preferably, the secondary pick-up assemblies are not used for signal generation. Furthermore, the pick-up operates either with or without an instrument mounted preamplifier. With the preamplifier in use, the signals from the primary and secondary pick-up assemblies are summed at the preamplifier before being conducted to the amplification system. The preamplifier may be bypassed and the signals from the primary pick-up assemblies conducted directly to the amplification system. When using this latter approach, the preamplifier summing resistors are bypassed so that the signal conducted to the amplification system is maximized, yet the possibility still exists for humbucking.

The present pick-up also includes a dual tone control arrangement so that the primary and secondary coils can be balanced simultaneously. Also, the arrangement of the primary coils is such that the operation of the secondary humbucking coils is not affected thereby.

OBJECTS, FEATURES AND ADVANTAGES

It is therefore the object of the present invention to solve the problems encountered heretofore in providing a humbucking pick-up for an electrical musical instrument of the stringed type. It is a feature of the present invention to solve these problems by providing a pick-up for an electrical musical instrument of the stringed type including a plurality of primary, signal-producing coils and a lesser number of secondary, humbucking coils. An advantage to be derived is a humbucking pick-up with a fewer number of coils. A further advantage is a pick-up which can be operated with or without a preamplifier. Another advantage is a pick-up which when used without a preamplifier maximizes the signal applied to the amplification system and permits humbucking, if desired. Still another advantage is a pick-up assembly having a dual tone control.

It is another feature of the invention to solve these problems by providing a pick-up for an electrical musical instrument of the stringed type which can be operated with or without a preamplifier. An advantage to be derived is a pick-up which, when used without a preamplifier, maximizes the signal applied to the amplification system and permits humbucking, if desired.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
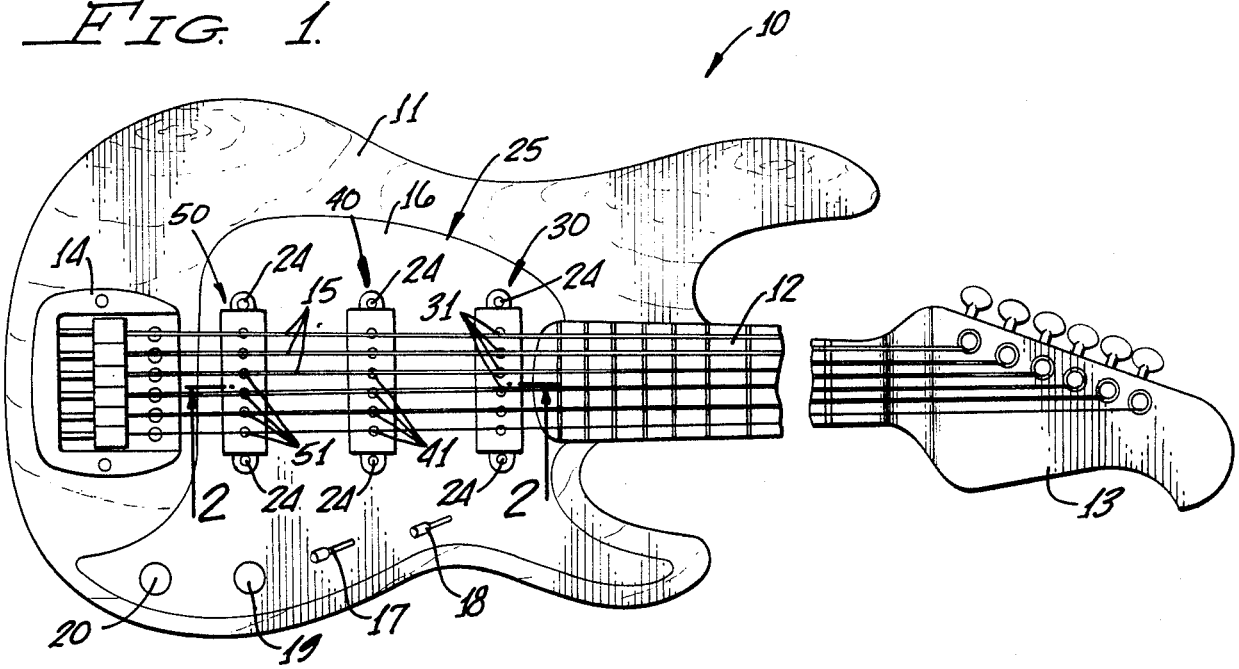
FIG. 1 is a partial top plan view of an electrical musical instrument of the stringed type incorporating a first embodiment of pick-up constructed in accordance with the teachings of the present invention.

Referring now to the drawings and, more particularly, to FIG. 1 thereof, the present invention is illustrated as being incorporated in an electrical guitar, generally designated 10, including a body 11, a fretted neck 12, and a head 13 being connected to one end of neck 12, the other end of neck 12 being connected to body 11. Tensioned between head 13 of guitar 10 and a bridge assembly 14 are a plurality of strings 15 which generally lie in a single plane parallel to the face of body 11. Strings 15 are constructed of a magnetizable substance, such as steel, and are graduated in diameter in a conventional manner.

Positioned on the face of body 11 is a pick guard 16 which is typically made from a plastic or other scratch-resistant material. Also mounted on the face of body 11 is a switch 17, a switch 18, a volume control 19 and a tone control 20.

In order to derive an output from guitar 10, it is provided with an electromagnetic pick-up, generally designated 25, which forms the subject matter of the present invention. Vibrations of strings 15, as a result of plucking or picking the same, produce electrical signals in pick-up 25, which signals may be suitably amplified and transmitted to a loudspeaker system.

Figure 2:
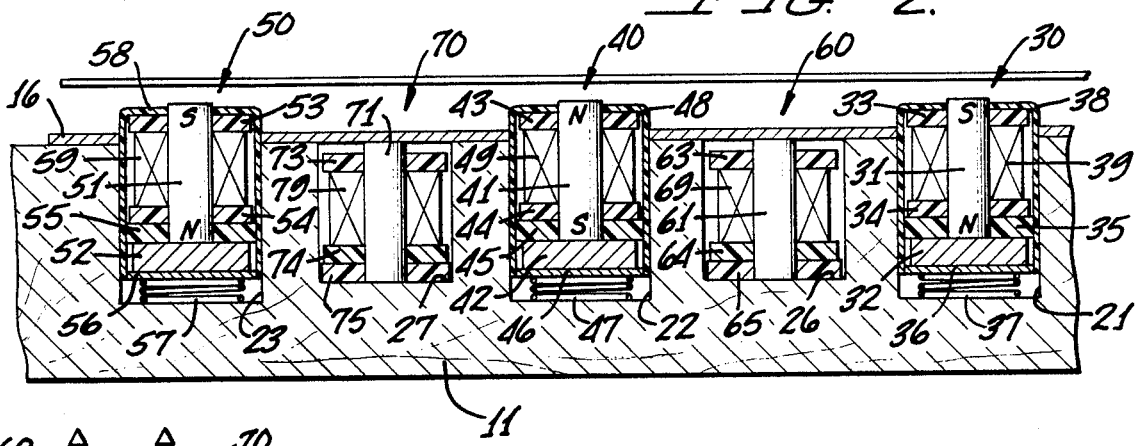
FIG. 2 is an enlarged sectional view taken along the line 2—2 in FIG. 1.
Figure 3:
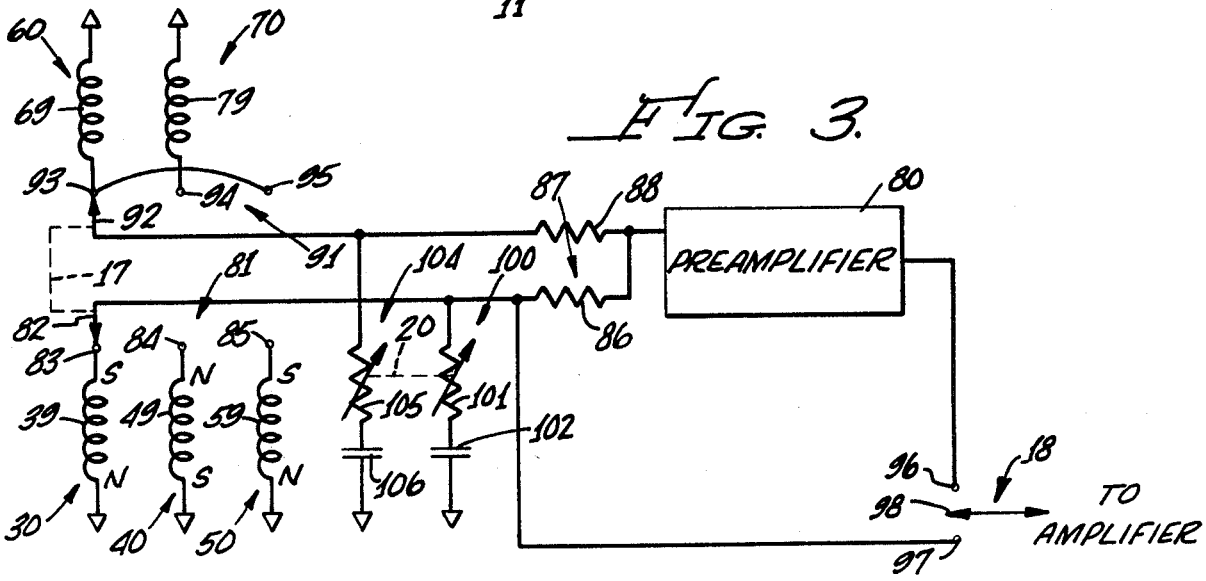
FIG. 3 is an electrical diagram of the pick-up of the instrument of FIG. 1.

Referring now to FIGS. 1–3, and in accordance with a first embodiment of the present invention, pick-up 25 includes first, second and third primary pick-up assemblies 30, 40 and 50, respectively, which are positioned in spaced relationship between neck 12 and bridge assembly 14 with pick-up assembly 40 being positioned between pick-up assemblies 30 and 50. Pick-up assemblies 30, 40 and 50 are identical and include a plurality of identical magnetic elements (pole pieces) 31, 41 and 51, respectively, which may be magnetized in any one of several ways known to those skilled in the art. The number of pole pieces in each pick-up assembly is preferably identical and preferably the same as the number of strings 15. However, such is not required and each pick-up assembly 30–50 can have any number of pole pieces from one or more. According to the preferred embodiment of the present invention, the individual pole pieces are not magnetized, but are made from a magnetizable substance and a magnetic field is produced by positioning a bar magnet 32, 42 and 52 in contact with the bases of pole pieces 31, 41 and 51, respectively.

Pick-up assemblies 30, 40 and 50 are constructed and mounted in body 11 in a conventional manner. For example, pick-up assembly 30 includes upper and lower support plates 33 and 34, through which pole pieces 31 extend, and a bottom support plate 35 which extends between lower support plate 34 and magnet 32. A magnetic keeper 36 extends along the bottom surface of magnet 32. The entire assembly is positioned within a channel 21 in body 11. A spring 37 extends between keeper 36 and the bottom of channel 21 to urge pick-up assembly 30 upwardly. A cap 38 surrounds and contains the pick-up assembly structure. Cap 38 and the upper ends of pole pieces 31 extend through pick guard 16 into close proximity with strings 15. A plurality of screws 24 extend through cap 38 and hold pick-up assembly 30 within channel 21 in body 11. In this manner, the height of pick-up assembly 30 may be adjusted relative to strings 15.

Pick-up assemblies 40 and 50 are positioned within channels 22 and 23, respectively, in body 11 and have parts corresponding to those discussed in connection with pick-up assembly 30. The corresponding parts have the same last number, with the first number being 3, 4 or 5 for pick-up assemblies 30, 40 and 50, respectively. The only difference is that all of pole pieces 31 and 51 of pick-up assemblies 30 and 50 have their south poles adjacent to strings 15 and their north poles relatively remote from strings 15 whereas all of pole pieces 41 of pickup assembly 40 have their north poles adjacent to strings 15 and their south poles relatively remote from strings 15. This arrangement may be reversed, the significant fact being that pole pieces 41 are oriented oppositely to pole pieces 31 and 51.

Coils 39, 49 and 59 are formed from a large number of turns of fine conductive wire and are wound around pole pieces 31, 41 and 51, respectively. The wire in coils 39, 49 and 59 is insulated, such as with varnish or lacquer, and the entire assemblies comprising the pole pieces, the supporting plates and the coils are preferrably dipped in a suitable varnish or lacquer. Coil 39 extends between support plates 33 and 34 and the arrangement is similar in pick-up assemblies 40 and 50. As known in the art, movement of strings 15, as in the strumming or playing of guitar 10, results in voltages being induced in coils 39, 49 and 59. As will be described more fully in connection with FIG. 3, these voltages are transferred to the input circuit of a preamplifier 80 before being conducted to a suitable loudspeaker system.

So that the signals from coils 39, 49 and 59 are additive, coil 49 is wound in an opposite direction to coils 39 and 59. Because the direction of current flow in each coil is governed by the magnetic polarity, the direction of current flow in coil 49 will be opposite to that in coils 39 and 59. However, since the direction of winding of coil 49 is opposite to coils 39 and 59, the voltages induced in all coils as a result of string vibrations are additive.

Pick-up 25 includes a first switch 81 which includes an arm 82 and three terminals 83, 84 and 85 which are connected to first ends of coils 39, 49 and 59, respectively, the other ends of these coils being connected to circuit ground. According to this embodiment of the invention, arm 82 is part of five-position switch 17 and can be connected either to terminal 83, terminals 83 and 84, terminal 84, terminals 84 and 85, or terminal 85. Arm 82 is also connected to a resistor 86 which is part of a summing circuit 87 connected to the input of preamplifier 80.

Pick-up 25 also includes secondary pick-up assemblies 60 and 70 positioned in spaced relationship between neck 12 and bridge assembly 14 with pick-up assembly 60 positioned between pick-up assemblies 30 and 40 and pick-up assembly 70 positioned between pick-up assemblies 40 and 50. Pick-up assemblies 60 and 70 are referred to as secondary because they are preferably not used for signal production and are only used for humbucking. Pick-up assemblies 60 and 70 are similar to pick-up assemblies 30, 40 and 50 in that they include pole pieces 61 and 71, respectively, support plates 63–65 and 73–75, respectively, and coils 69 and 79, respectively. Pick-up assemblies 60 and 70 differ from pick-up assemblies 30, 40 and 50 in that pole pieces 61 and 71 of pick-up assemblies 60 and 70 are not magnetized and pick-up assemblies 60 and 70 preferably do not include magnets, caps or springs. Pick-up assemblies 60 and 70 are mounted within channels 26 and 27, respectively, in body 11 of guitar 10 and are preferably positioned below pick guard 16 so that they are not generally visible. The reason for this is described more fully in my co-pending application Ser. No. 598,219, filed concurrently herewith, and entitled Humbucking Pick-up Assembly Including an Unmagnetized, Disassociated Coil. Pick-up assemblies 60 and 70 are used exclusively for humbucking.

Coil 69 of pick-up assembly 60 is wound in a direction opposite to coils 39 and 59 of pick-up assemblies 30 and 50, respectively, and coil 79 of pick-up assembly 70 is wound in a direction opposite to coil 49 of pick-up assembly 40. Because coils 69 and 79 are unmagnetized, they are not responsive to string vibrations. On the other hand, coils 69 and 79 do pick up noise signals which are not dependent upon a magnetic polarity. Because of the opposite direction of winding, coil 69 is capable of operating in a humbucking arrangement with coils 39 and 59 and coil 79 is capable of operating in a humbucking arrangement with coil 49.

Pick-up 25 includes a second switch 91 which includes an arm 92 and three terminals 93, 94, and 95. Arm 92 is part of switch 17 and can be connected either to terminal 93, terminals 93 and 94, terminal 94, terminals 94 and 95 or terminal 95. Terminals 93 and 94 are connected to first ends of coils 69 and 79, respectively, the other ends of which are connected to circuit ground. Terminal 95 is connected to terminal 93. Arm 92 is also connected to a resistor 88 which is part of summing circuit 87 for preamplifier 80. Arms 82 and 92 are mechanically interconnected for simultaneous movement under control of switch 17 of guitar 10.

In operation, it is seen that when using preamplifier 80, summing circuit 87 sums the signals from coils 39, 49, 59, 69 and/or 79 at the input of preamplifier 80, depending upon the position of switch 17. When in its first position, the signals from coils 39 and 69 are conducted to preamplifier 80 and, for reasons described more fully hereinbefore, coils 39 and 69 function in a humbucking arrangement. It should also be noted that since coil 69 is not magnetized, it does not affect the signal producing qualities of coil 39. When moved to the second position, switch 17 conducts the signals from coils 39, 49, 69 and 79 to preamplifier 80, with coils 79 and 49 operating in a humbucking arrangement. In the third position, the signals from coils 49 and 79 are conducted to preamplifier 80. In the fourth position, because of the connection between terminals 93 and 95, the signals from coils 49, 59, 69 and 79 are conducted to the input of preamplifier 80. In the fifth position, the signals from coils 59 and 69 are conducted to preamplifer 80. Thus, it is seen that coil 69 functions as a humbucker for both of coils 39 and 59 and only two secondary coils are required rather than three.

It is highly desirable that pick-up 25 function if preamplifier 80 becomes inoperative either because of problems associated therewith or because the batteries that run same within guitar 10 go dead. Accordingly, the output of preamplifier 80 is connected to a first terminal 96 of switch 18, switch 18 having another terminal 97 which is connected directly to arm 82 of switch 81. Switch 18 has an arm 98 which is connectable either to terminal 96 or terminal 97. When connected to terminal 96, operation is as just described. When connected to terminal 97, the signals from coils 39, 49 or 59 are conducted directly to the amplification system, thereby bypassing summing resistor 86 and maximizing the signal strength conducted to the amplifier. As before, switch 17 can be placed in any one of five positions so that the outputs of single coils or dual coils may be conducted to the amplifier. However, it should be particularly noted that with switch 17 in either the second or the fourth position, the signals from coils 39 and 49 or coils 49 and 59 are summed before being conducted to the amplifier. Since pick-up assembly 40 has its pole pieces and coils wound opposite to pick-up assemblies 30 and 50, coil 49 operates as a humbucker with either of coils 39 or 59. Thus, even without preamplifier 80 and secondary coils 69 and 79, humbucking can be achieved with pick-up 25.

It should also be noted that since the polarities of the pole pieces on opposite sides of each secondary pick-up are different, the effects of the primary coils on the secondary coils cancel and better humbucking is achieved than if all of the pole pieces of the primary coils had the same polarity. Since the magnetic fields of the primary coils cancel at the secondary coils, they are freer to pick up extraneous noise sounds.

The primary coils and the secondary coils are each provided with separate tone control circuits 100 and 104, respectively. While such tone control circuits might not be so simple, for explanation purposes, tone control circuit 100 is shown as including a variable resistor 101 and a capacitor 102 connected in series between arm 82 of switch 81 and circuit ground and tone control circuit 104 is shown as including a variable resistor 105 and a capacitor 106 connected in series between circuit ground and arm 92 of switch 91. According to the preferred embodiment of the invention, the variable resistors are mechanically interconnected and become the tone control circuit 20 of instrument 10 so that the primary coils and secondary coils may be balanced simultaneously.

According to a second embodiment of the invention, pick-up 25 includes primary pick-up assemblies 30 and 40 and secondary pick-up assemblies 60 and 70 and switch 17 is a three-position switch where arms 82 and 92 can be connected either to terminals 83 and 93, respectively, terminals 83 and 84 and terminals 93 and 94, respectively, or terminals 84 and 94, respectively. This arrangement would be used where a musician wants only two primary coils rather than three. While this embodiment does not have the advantage of providing humbucking pairs with a lesser number of coils, the remaining advantages of the present invention still apply.

That is, in operation, when using preamplifier 80, operation is similar to conventional humbucking pick-up assemblies in that each primary coil has its own secondary humbucking coil. However, when preamplifier 80 becomes inoperative, arm 98 of switch 18 may be positioned in contact with terminal 97 and switch 17 may be placed in its middle position where the signals from coils 39 and 49 are summed before being conducted to the amplifier. Since pick-up assembly 40 has its pole pieces and coils wound opposite to pick-up assembly 30, coils 39 and 49 operate as a humbucking pair. Thus, even without preamplifier 80 and coils 69 and 79, humbucking can be achieved with pick-up 25.

Referring now to FIGS. 4–7, according to a third embodiment of the invention, pick-up 25 includes primary pick-up assemblies 30 and 40 and secondary pick-up assembly 60 and switch 17 is replaced by a switch 110. Switch 110 is also a three-position switch but has a more complex arrangement so that coil 69 of secondary pick-up assembly 60 can be used as a humbucker for either coil 39 of primary pick-up assembly 30 or coil 49 of primary pick-up assembly 40.

Figure 4:
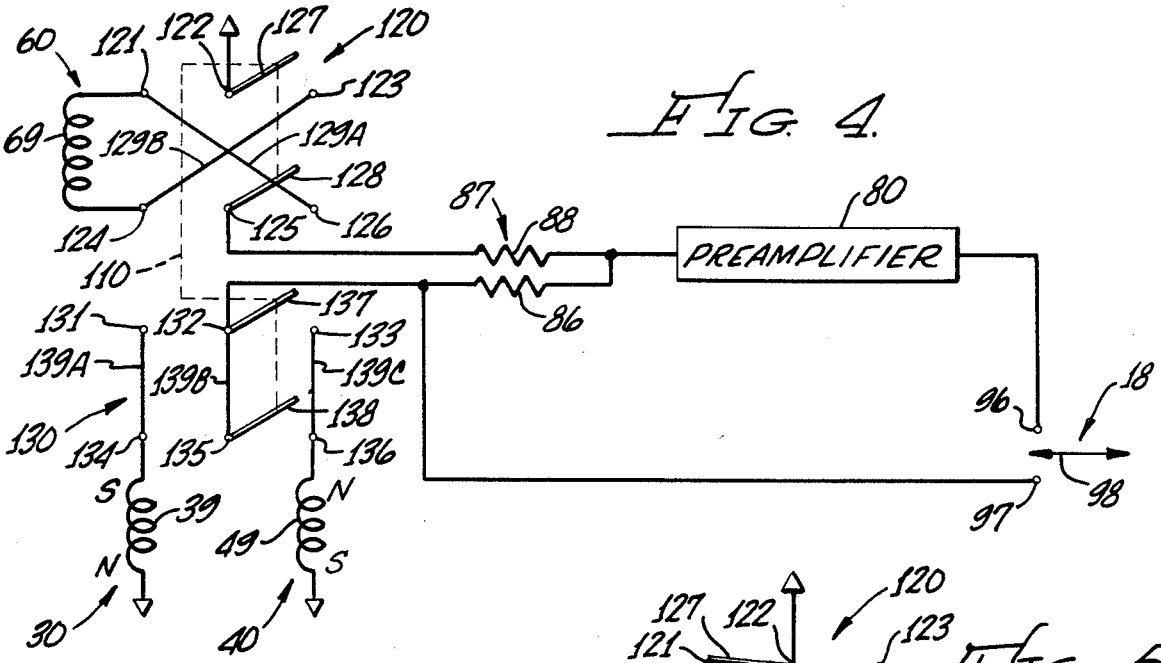
FIG. 4 is an electrical diagram of a third embodiment of pick-up constructed in accordance with the teachings of the present invention.

Referring now to FIG. 4, switch 110 includes first and second switch sections 120 and 130, respectively, which include sixe terminals 121–126 and 131–136, respectively. Switch section 120 includes a pair of switch arms 127 and 128, first ends of which are connected to terminals 122 and 125, respectively. Coil 69 is connected between terminals 121 and 124. Terminal 122 is connected to ground and terminal 125 is connected to summing circuit 87. Terminal 121 is connected to terminal 126 by a jumper 129A and terminal 123 is connected to terminal 124 by a jumper 129B.

Switch section 130 includes a pair of switch arms 137 and 138, first ends of which are connected to terminals 132 and 135, respectively. Coil 39 is connected between terminal 134 and ground whereas coil 49 is connected between terminal 136 and ground. Terminal 132 is connected to summing circuit 87. A jumper wire 139A is connected between terminals 131 and 134, a jumper wire 139B is connected between terminals 132 and 135 and a jumper wire 139C is connected between terminals 133 and 136.

Figure 5:
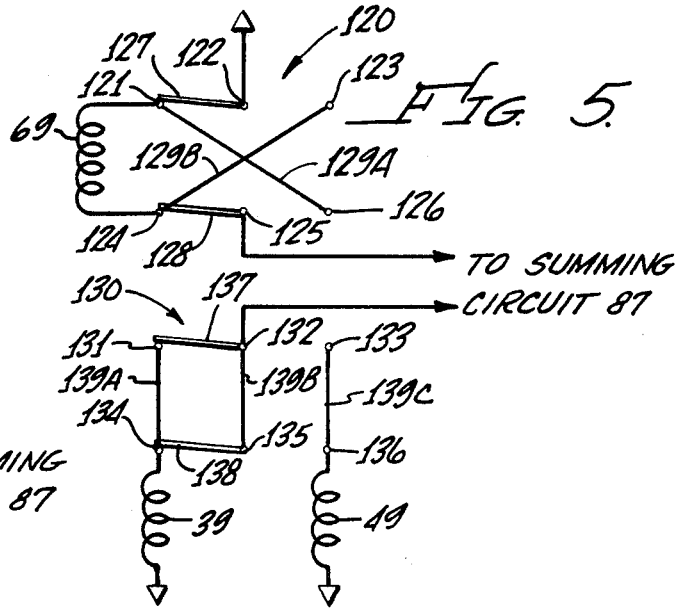
FIGS. 5–7 are electrical diagrams showing the three switch positions of the pick-up of FIG. 4.
Figure 6:
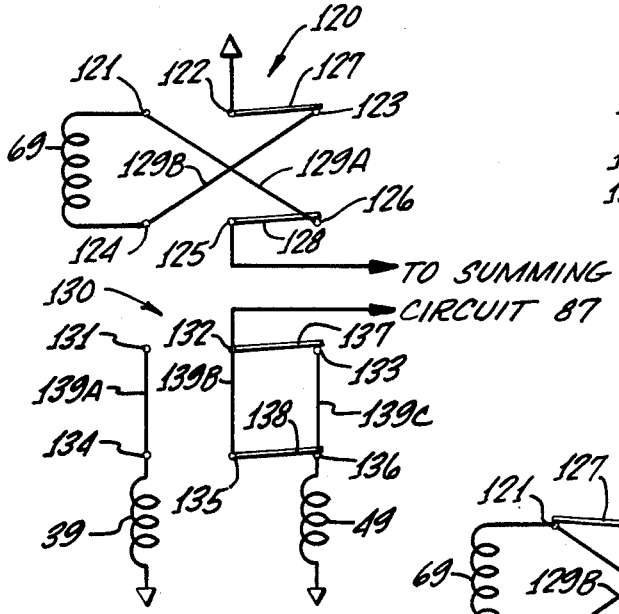
Figure 7:
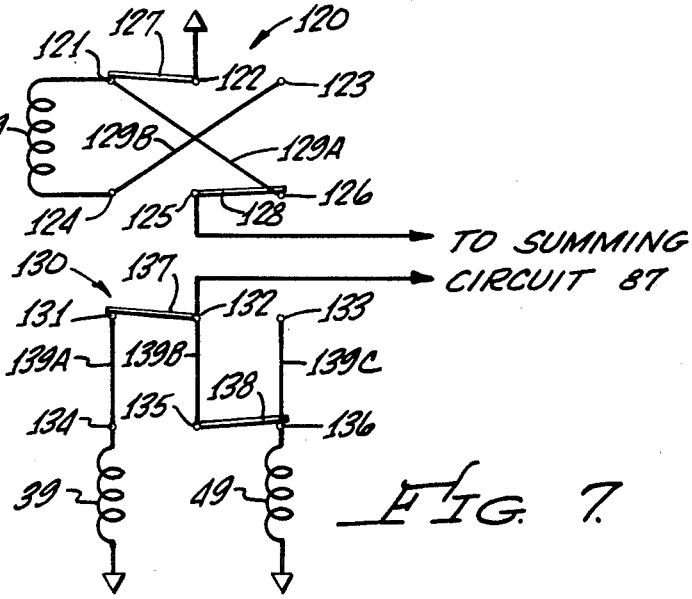

The three positions of switch sections 120 and 130 are shown in FIGS. 5, 6 and 7. With reference to FIG. 5, it is seen that in a first position of switch 110, arms 127, 128, 137 and 138 are in contact with terminals 121, 124, 131 and 134, respectively. In this position, coils 39 and 69 are connected to summing circuit 87. As described previously, coil 69 is wound in an opposite direction to coil 39 so that the arrangement achieves humbucking in the same manner as previously described.

In the position of switch 110 shown in FIG. 6, arms 127, 128, 137 and 138 are in contact with terminals 123, 126, 133 and 136, respectively. In this position, coils 49 and 69 are connected to summing circuit 87. However, since coil 49 is wound in an opposite direction to coil 39, it should be noted that the terminals of coil 69 are reversed before connecting it to summing circuit 87 so that coil 69 can function in a humbucking arrangement with coil 49. It is this technique for reversing the leads of coil 69 which enables it to function as a humbucker for both coils 39 and 49.

FIG. 7 shows the middle position of switch 110 where arms 127, 128, 137 and 138 are in contact with terminals 121, 126, 131 and 136, respectively. It is immediately noted that coils 39 and 49 are connected in parallel and that coil 69 is bypassed. It will be recalled that coils 39 and 49 are wound in opposite directions and that the pole pieces associated therewith are oppositely poled. For reasons explained previously, the signals from coils 39 and 49 are additive and they comprise a humbucking arrangement. This eliminates the necessity for using coil 69 for humbucking and it is not so used. It is also this position of switch 110 which would be used when arm 98 of switch 18 is in contact with terminal 97.

It can therefore be seen that this embodiment has the advantage of providing humbucking pairs with a lesser number of coils while all of the remaining advantages of the present invention still apply. The third embodiment of the invention may include a dual tone control circuit as described previously.

While the invention has been described with respect to the preferred physical embodiments constructed in accordance therewith, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. In a pick-up for an electrical musical instrument of the type including a body, a neck having a head, a bridge assembly connected to said body, and a plurality of strings positioned between said head and said bridge assembly, the improvement comprising:

first, second and third primary pick-up assemblies positioned in spaced relationship between said neck and said bridge assembly with said second pick-up assembly positioned between said first and third pick-up assemblies;

fourth and fifth secondary pick-up assemblies positioned in spaced relationship between said neck and said bridge assembly with said fourth pick-up assembly positioned between said first and second pick-up assemblies and said fifth pick-up assembly positioned between said second and third pick-up assemblies;

each of said pick-up assemblies including at least one pole piece and a coil wound therearound, the coil of said fourth pick-up assembly being wound in a direction opposite to the coils of said first and third pick-up assemblies and the coil of said fifth pick-up assembly being wound in a direction opposite to the coil of said second pick-up assembly;

summing means for summing the signals from multiple ones of said pick-up assemblies for conducting said signals to amplification means;

first switch means including an arm and three terminals, one end of said arm being connected to an input of said summing means, said arm being positionable in contact with any of said terminals, said first, second and third terminals of said first switch means being connected to said coils of said first, second and third pick-up assemblies, respectively;

second switch means including an arm and three terminals, said arm being connected to an input of said summing means and being positionable in contact with any of said terminals of said second switch means, said first and second terminals of said second switch means being connected to said coils of said fourth and fifth pick-up assemblies, respectively, said first terminal of said second switch means being connected to said third terminal thereof; and means for mechanically interconnecting said arms of said first and second switch means whereby said arms simultaneously contact said first, second and third terminals, respectively, of said first and second switch means.

2. In a pick-up for an electrical musical instrument according to claim 1, the improvement wherein the arms of both of said first and second switch means have five positions and are positionable in contact with said first terminals only, said first and second terminals, said second terminals only, said second and third terminals, or said third terminals only of said switch means.

3. In a pick-up for an electrical musical instrument according to claim 2, the improvement wherein the coil of said second pick-up assembly is wound in a direction opposite to the coils of said first and third pick-up assemblies and the magnetic polarity of the pole piece of said second pick-up assembly is opposite to that of said first and third pick-up assemblies.

4. In a pick-up for an electrical musical instrument according to claim 3, the improvement further comprising:

amplification means connected to the output of said summing means; and third switch means including an arm and first and second terminals, said arm of said third switch means providing the output of said pick-up and being positionable in contact with either of said terminals thereof, said first terminal of said third switch means being connected to the output of said amplification means, said second terminal of said said third switch means being connected to said arm of said first switch means whereby when said arm of said third switch means is in contact with said second terminal thereof, said summing means and said amplification means are bypassed and the output of said pick-up is from said first switch means only.

5. In a pick-up for an electrical musical instrument according to claim 1, the improvement wherein the coil of said second pick-up assembly is wound in a direction opposite to the coils of said first and third pick-up assemblies and the magnetic polarity of the pole piece of said second pick-up assembly is opposite to that of said first and third pick-up assemblies.

6. In a pick-up for an electrical musical instrument according to claim 1, the improvement further comprising:

a first tone control circuit connected to said arm of said first switch means, said first tone control circuit having a first variable element; and a second tone control circuit connected to said arm of said second switch means, said second tone control circuit having a second variable element;

said first and second variable elements being mechanically interconnected for simultaneous adjustment.

7. In a pick-up for an electrical musical instrument according to claim 1, the improvement wherein said pole pieces of said first, second and third pick-up assemblies are magnetized and wherein said pole pieces of said fourth and fifth pick-up assemblies are unmagnetized.

8. In a pick-up for an electrical musical instrument of the type including a body, a neck having a head, a bridge assembly connected to said body, and a plurality of strings positioned between said head and said bridge assembly, the improvement comprising:

first and second primary pick-up assemblies positioned in spaced relationship between said neck and said bridge assembly;

third and fourth secondary pick-up assemblies positioned in spaced relationship between said neck and said bridge assembly with said third and fourth pick-up assemblies positioned adjacent said first and second pick-up assemblies, respectively;

each of said pick-up assemblies including at least one pole piece and a coil wound therearound, the pole pieces of said first and second pick-up assemblies being magnetized and the magnetic polarity of the pole piece of said second pick-up assembly being opposite to that of said first pick-up assembly, the coil of the second pick-up assembly being wound in a direction opposite to the coil of said first pick-up assembly, the coil of the third pick-up assembly being wound in a direction opposite to the coil of said first pick-up assembly and the coil of said fourth pick-up assembly being wound in a direction opposite to the coil of said second pick-up assembly;

summing means for summing the signals from multiple ones of said pick-up assemblies for conducting said signals to amplification means;

first switch means including an arm and two terminals, one end of said arm being connected to an input of said summing means, said arm being positionable in contact with either one or both of said terminals, said first and second terminals of said first switch means being connected to said coils of said first and second pick-up assemblies, respectively;

second switch means including an arm and two terminals, said arm being connected to an input of said summing means and being positionable in contact with either one or both of said terminals of said second switch means, said first and second terminals of said second switch means being connected to said coils of said third and fourth pick-up assemblies, respectively;

means for mechanically interconnecting said arms of said first and second switch means whereby said arms simultaneously contact said first and second terminals, respectively, of said first and second switch means;

amplification means connected to the output of said summing means; and third switch means including an arm and first and second terminals, said arm of said third switch means providing the output of said pick-up and being positionable in contact with either of said terminals thereof, said first terminal of said third switch means being connected to the output of said amplification means, said second terminal of said third switch means being connected to said arm of said first switch means whereby when said arm of said third switch means is in contact with said second terminal thereof, said summing means and said amplification means are bypassed and the output of said pick-up is from said first switch means only.

9. In a pick-up for an electrical musical instrument according to claim 8, the improvement further comprising:

a first tone control circuit connected to said arm of said first switch means, said first tone control circuit having a first variable element; and a second tone control circuit connected to said arm of said second switch means, said second tone control circuit having a second variable element;

said first and second variable elements being mechanically interconnected for simultaneous adjustment.

10. In a pick-up for an electrical musical instrument according to claim 8, the improvement wherein said pole pieces of said first, second and third pick-up assemblies are magnetized and wherein said pole pieces of said fourth and fifth pick-up assemblies are unmagnetized.

11. In a pick-up for an electrical musical instrument of the type including a body, a neck having a head, a bridge assembly connected to said body and a plurality of strings positioned between said head and said bridge assembly, the improvement comprising:

first and second primary pick-up assemblies positioned in spaced relationship between said neck and said bridge assembly;

a secondary pick-up assembly positioned in spaced relationship between said neck and said bridge assembly, between said first and second pick-up assemblies;

each of said pick-up assemblies including at least one pole piece and a coil wound therearound;

summing means for summing the signals from multiple ones of said pick-up assemblies for conducting signals to amplification means;

first three-position switch means connected between said first and second pick-up assemblies and said summing means, said first switch means connecting said coil of said first pick-up assembly to said summing means in a first position thereof, both of said coils of said first and second pick-up assemblies to said summing means in a second position thereof and said coil of said second pick-up assembly to said summing means in a third position thereof, said first switch means connecting said coils of said first and second pick-up assemblies in a humbucking arrangement in said second position thereof;

second three-position switch means connected between said secondary pick-up assembly and said summing means, said second switch means connecting said coil of said secondary pick-up assembly to said summing means in the first and third positions thereof and not connecting said coil of said secondary pick-up assembly to said summing means in said second position thereof, said second switch means reversing the polarity of said coil of said secondary pick-up assembly when switching from said first to said third position so as to provide a humbucking arrangement with both said first and second primary pick-up asemblies; and means for mechanically interconnecting said first and second switch means for simultaneous movement to said first, second and third positions thereof.

12. In a pick-up for an electrical musical instrument according to claim 11, the improvement wherein said coil of said second pick-up assembly is wound in a direction opposite to said coil of said first pick-up assembly and the magnetic polarity of the pole piece of said second pick-up assembly is opposite to that of said first pick-up assembly.

13. In a pick-up for an electrical musical instrument according to claim 11, the improvement wherein said pole pieces of said first and second pick-up assemblies are magnetized and wherein said pole pieces of said secondary pick-up assembly are unmagnetized.

14. In a pick-up for an electrical musical instrument of the type including a body, a neck having a head, a bridge assembly connected to said body and a plurality of strings positioned between said head and said bridge assembly, the improvement comprising:

a plurality of primary pick-up assemblies positioned in spaced relationship between said neck and said bridge assembly;

at least one secondary pick-up assembly positioned in spaced relationship between said neck and said bridge assembly, the number of secondary pick-up assemblies being less than the number of primary pick-up assemblies;

each of said pick-up assemblies including at least one pole piece and a coil wound therearound;

summing means for summing the signals from multiple ones of said pick-up assemblies for conducting said signals to amplification means; and switch means for connecting said pick-up assemblies to said summing means in a manner such that one secondary pick-up assembly is used alternately for humbucking with two primary pick-up assemblies or two primary pick-up assemblies are used for humbucking each other.

15. In a pick-up for an electrical musical instrument according to claim 14, the improvement wherein said pole pieces of said primary pick-up assemblies are magnetized and wherein said pole pieces of said secondary pick-up assemblies are unmagnetized.

* * * * *